US010545452B2

(12) United States Patent
Kobayashi et al.

(10) Patent No.: US 10,545,452 B2
(45) Date of Patent: Jan. 28, 2020

(54) IMAGE FORMING DEVICE INCLUDING HANDLE WITH SHIFTABLE OPERATIONAL POSITIONS

(71) Applicant: Oki Data Corporation, Tokyo (JP)

(72) Inventors: Takashi Kobayashi, Tokyo (JP); Yuta Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/249,507

(22) Filed: Jan. 16, 2019

(65) Prior Publication Data

US 2019/0219964 A1 Jul. 18, 2019

(30) Foreign Application Priority Data

Jan. 16, 2018 (JP) ..... 2018-004723
Apr. 25, 2018 (JP) ..... 2018-084172

(51) Int. Cl.

*G03G 15/20* (2006.01)
*G03G 21/16* (2006.01)
*G03G 15/00* (2006.01)
*G03G 21/20* (2006.01)

(52) U.S. Cl.

CPC ..... *G03G 21/1685* (2013.01); *G03G 15/50* (2013.01); *G03G 21/206* (2013.01)

(58) Field of Classification Search

CPC .. G03G 21/1685; G03G 21/206; G03G 15/50; G03G 15/2017; G03G 2221/1639; G03G 2221/1645

See application file for complete search history.

(56) References Cited

U.S. PATENT DOCUMENTS 6,285,846 B1 * 9/2001 Suzuki ..... G03G 21/1685 399/122
8,688,005 B2 * 4/2014 Nozawa ..... G03G 21/1685 399/107
2006/0008294 A1 * 1/2006 Ito ..... 399/122
2008/0050144 A1 * 2/2008 Hashimoto ..... G03G 15/2017 399/92
2011/0211860 A1 * 9/2011 Shimoyama ..... 399/93
2012/0148290 A1 * 6/2012 Asami ..... 399/92
2014/0314438 A1 * 10/2014 Maeda ..... G03G 21/1685 399/92
2018/0314197 A1 * 11/2018 Konishi

FOREIGN PATENT DOCUMENTS

JP 2008-089809 A 4/2008
JP 2010181667 A * 8/2010

OTHER PUBLICATIONS

Machine translation of JP 2010-181667 (application No. 2009-025604, publication date of Aug. 19, 2010) printed on Jul. 1, 2019.*

* cited by examiner

*Primary Examiner* — Sophia S Chen
(74) *Attorney, Agent, or Firm* — Rabin & Berdo, P.C.

(57) ABSTRACT

An image forming device includes a development unit that forms a toner image, a fixation unit that includes a handle including a grip part and fixes the toner image transferred to a record medium on the record medium and a heat insulation duct that is situated between the development unit and the fixation unit and inhibits transmission of heat of the fixation unit to the development unit. The handle is provided to be able to shift between an operational position for being gripped by an operator and an operating position at which the handle is in contact with the heat insulation duct.

19 Claims, 13 Drawing Sheets

IMAGE FORMING DEVICE INCLUDING HANDLE WITH SHIFTABLE OPERATIONAL POSITIONS

BACKGROUND OF THE INVENTION

1. Field of the Invention

The present invention relates to an image forming device such as a printer and a copying machine, and in particular, to an image forming device including a detachable fixation device.

2. Description of the Related Art

An image forming device, as typified by an electrophotographic printer, forms an image on a record medium by transferring a toner image onto the record medium by use of a photosensitive drum and a transfer belt and thereafter fixing the toner image on the record medium by use of a fixation unit including a pressure roller, a fixation roller including a heating member, and so forth. As an example of the fixation unit, there exists a fixation unit that includes a handle part and is configured to be detachable for replacement and maintenance (see Japanese Patent Application Publication No. 2008-89809 (Pages 4 to 5, FIG. 3), for example).

However, after the image forming device has printed on a lot of record media, the fixation unit can rise to a high temperature and the handle part can become hot, and thus existing image forming devices attract the user's attention by using a high temperature caution label or the like when the user attaches or detaches the fixation unit. Further, "IEC62368-1" as a product safety standard stipulates that a plastic part making contact with the user for 10 seconds or longer and less than one minute has to be kept lower than or equal to 60° C. In a case where the handle part of the fixation unit contradicts this condition, it is necessary to take some kind of measures for cooling.

SUMMARY OF THE INVENTION

An image forming device according to an aspect of the present invention includes a development unit that forms a developing agent image, a fixation unit that includes a handle including a grip part and fixes the developing agent image transferred to a record medium on the record medium, and a heat insulation duct that is situated between the development unit and the fixation unit and inhibits transmission of heat of the fixation unit to the development unit. The handle is provided to be able to shift between a first position for being gripped by an operator and a second position at which the handle is in contact with the heat insulation duct.

An image forming device according to another aspect of the present invention includes an upper cover that opens and closes an inside of a main body of the image forming device and has an opening part, and a fixation unit that includes a handle including a grip part and is provided to be detachable from the main body of the image forming device. A part of the handle is exposed to an outside of the image forming device via the opening part when the upper cover is at a position at which the inside of the main body of the image forming device is closed.

According to the present invention, it is possible to efficiently release the heat of the handle of the fixation unit during the print operation, and thus it is possible to inhibit the grip part of the handle from rising to a high temperature.

BRIEF DESCRIPTION OF THE DRAWINGS

In the attached drawings:

FIGS. 2A and 2B are external perspective views showing states in which development units and a fixation unit have been removed from the main body of the image forming device, wherein FIG. 2A shows a state in which the development units have been removed and FIG. 2B shows a state in which the fixation unit has also been removed;

FIGS. 3A and 3B are external perspective views of the fixation unit, wherein FIG. 3A shows a state in which a handle is at an operational position of projecting upward from the upper part of the fixation unit and FIG. 3B shows a state in which the handle is at an operating position of bending forward from the upper part of the fixation unit;

FIGS. 4A and 4B are partially enlarged views magnifying the fixation unit attached to a prescribed position in the image forming device in the first embodiment and a part in the vicinity of the fixation unit, wherein FIG. 4A shows a state in which an upper cover is at an open position and the handle of the fixation unit is at the operational position and FIG. 4B shows a state in which the handle of the fixation unit is at the operating position and the upper cover is at a closed position;

FIGS. 5A and 5B are partially enlarged views magnifying the fixation unit and a part in the vicinity of the fixation unit in a first modification, wherein FIG. 5A shows the state in which the upper cover is at the open position and the handle of the fixation unit is at the operational position and FIG. 5B shows the state in which the handle of the fixation unit is at the operating position and the upper cover is at the closed position;

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1:
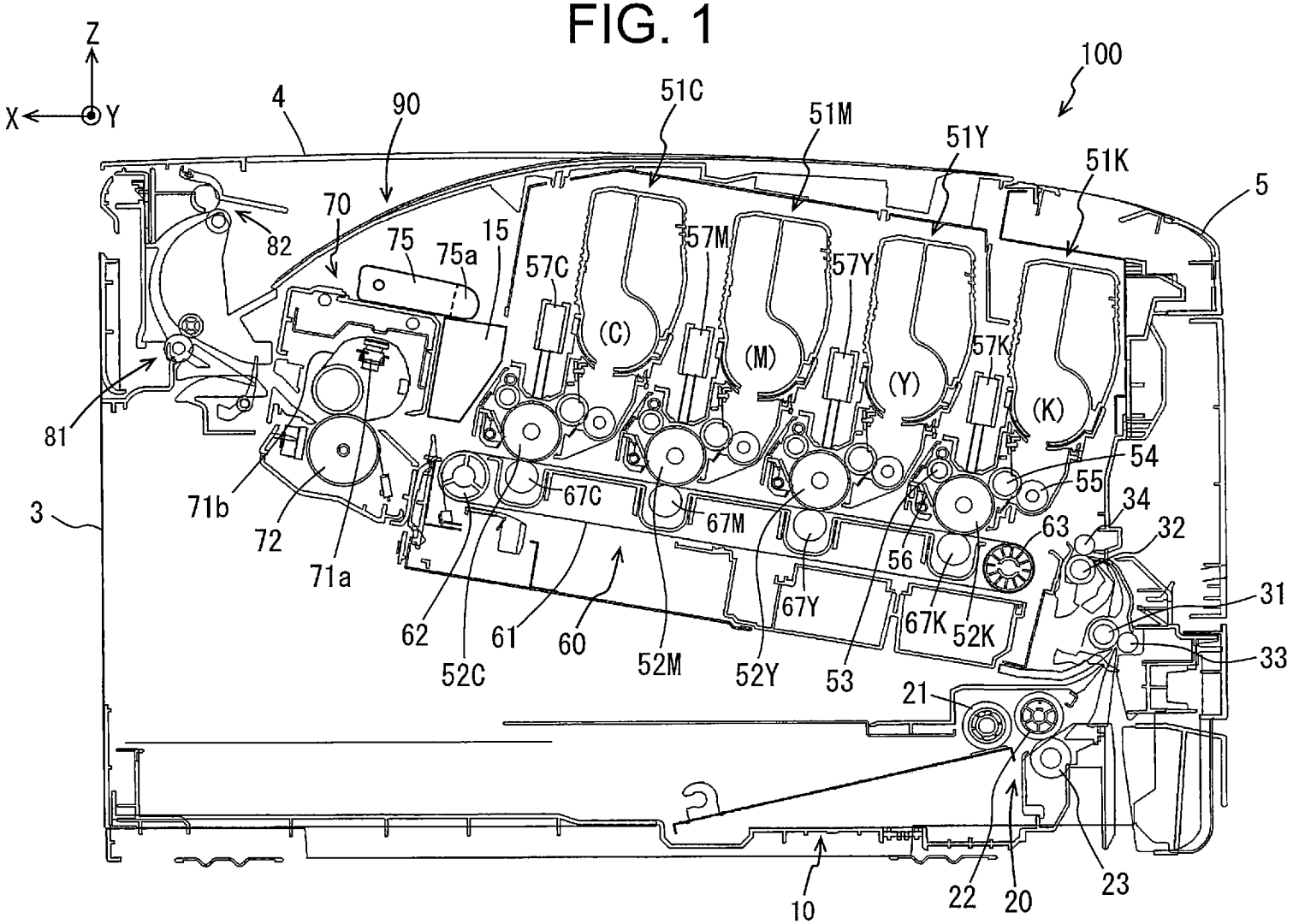
FIG. 1 is a principal part configuration diagram showing a principal part configuration of an image forming device according to a first embodiment according to the present invention.

FIG. 1 is a principal part configuration diagram showing a principal part configuration of an image forming device according to a first embodiment of the present invention.

As shown in FIG. 1, the image forming device 100 has a configuration as a tandem color electrophotographic printer, for example, and a sheet feed cassette 10 is attached to the image forming device 100 in a detachable manner. In the inside of the sheet feed cassette 10, recording sheets as record media are stacked up. A pickup roller 21, in combination with a sheet feed roller 22 and a separation roller 23 arranged as a pair in contact with each other, forms a sheet feed section 20. The pickup roller 21 and the sheet feed roller 22 are rotationally driven by a non-illustrated rotary drive means, and the separation roller 23 generates torque in a reverse rotation direction by a non-illustrated torque generation means.

Accordingly, the pickup roller 21 pulls out the uppermost recording sheet, which is in contact with it, from the sheet feed cassette 10, and the sheet feed roller 22 and the separation roller 23 successively let out the recording sheets sheet by sheet to a conveyance path even when two or more recording sheets are pulled out at the same time, for example.

In the conveyance path downstream of the sheet feed section 20 in a conveyance direction of the recording sheet, a registration roller 31 and a conveyance roller 32 are arranged in sequence. The registration roller 31 is paired with a driven pressure roller 33 pressing against the registration roller 31 to cause conveyance force. The conveyance roller 32 is paired with a driven pressure roller 34 pressing against the conveyance roller 32 to cause conveyance force. The roller pair of the registration roller 31 corrects the skew of the recording sheet, and the roller pair of the conveyance roller 32 feeds the recording sheet into an image forming section.

The image forming section includes four development units 51K, 51Y, 51M and 51C (a reference character 51 will be assigned when distinction among these units is not particularly necessary) arranged in series in a detachable manner and a transfer section 60 that transfers toner development images formed by the development units 51 onto an upper surface of the recording sheet by use of Coulomb force. The four development units 51 arranged in series are the same as each other in the configuration and differ from each other only in the color of the toner used, namely, black (K), yellow (Y), magenta (M) or cyan (C), and their operation timings. In this example, the development unit 51K for black (K), the development unit 51Y for yellow (Y), the development unit 51M for magenta (M) and the development unit 51C for cyan (C) are successively arranged from the upstream side in the sheet conveyance direction.

Thus, in this description, the internal configuration of the development unit 51K for black (K) will be described below as a representative example.

The development unit 51K includes a photosensitive drum 52K for bearing the toner development image, a charging roller 53 for electrically charging the surface of the photosensitive drum 52K, a development roller 54 for forming the toner development image with frictional charging by developing an electrostatic latent image famed on the charged surface of the photosensitive drum 52K by means of exposure by an LED head 57K, a toner supply roller 55 for supplying the toner to the development roller 54, a cleaning blade 56 for scraping off residual toner remaining on the surface of the photosensitive drum 52K after the transfer, and so forth. Incidentally, to the drums and the rollers used for the development units 51, motive power is transmitted from non-illustrated drive motors via a gear and so forth.

The transfer section 60 includes a transfer belt 61 for electrostatically adsorbing and conveying the recording sheet, a drive roller 62 for driving the transfer belt 61, a tension roller 63 paired with the drive roller 62 to have the transfer belt 61 stretched, transfer rollers 67K, 67Y, 67M and 67C (a reference character 67 will be assigned when distinction among these rollers is not particularly necessary) arranged to respectively face and press against the photosensitive drums 52K, 52Y, 52M and 52C (a reference character 52 will be assigned when distinction among these rollers is not particularly necessary) of the development units 51 and applying voltage so as to transfer the toner development images to the recording sheet, and so forth.

The development units 51 and the transfer belt 61 are driven in synchronization with each other, and the toner development images of the colors are successively transferred onto and stacked on the recording sheet electrostatically adsorbed by the transfer belt 61. The recording sheet to which the toner development images have been transferred as above in the image forming section is sent out to a fixation unit 70 that fuses the toner development images to the recording sheet by heat and pressure.

The fixation unit 70 arranged in a detachable manner includes a fixation belt 71*b* including a heat source 71*a* such as a heater and making contact with the recording sheet from above and a backup roller 72 that rotates following the movement of the fixation belt 71*b*. The recording sheet is conveyed between the heated fixation belt 71*b* and the backup roller 72, and thereby the toners adhering to the recording sheet are fused by the heat of the fixation belt 71*b* and the toner images are fixed on the recording sheet.

In the conveyance path downstream of the fixation unit 70 in the conveyance direction of the recording sheet, ejection roller pairs 81 and 82 are arranged in sequence, by which the recording sheet after the fixation ejected from the fixation unit 70 is conveyed along the path and ejected to an ejection tray 90.

A heat insulation duct 15 is arranged between the fixation unit 70 and the development unit 51C for cyan (C) arranged at the downstream end of the four development units 51 in the sheet conveyance direction. As will be described later, the heat insulation duct 15 is situated between the development unit 51C and the fixation unit 70 and extends in a rotation axis direction of the photosensitive drums 52 of the development units 51. In the inside of the heat insulation duct 15, outside air taken in by an air-cooling fan 8 from the outside of the device flows.

Accordingly, heat of the fixation unit 70 is transmitted to the outside air flowing in the inside of the heat insulation duct 15, successively discharged to the outside, and hardly transmitted to the development units 51. Thereby, problems occurring in the development units 51 due to heat, such as adhesion of toners, can be reduced.

As will be explained later, the fixation unit 70 includes a handle 75 to be used as a grip when the fixation unit 70 is attached, detached, or conveyed. As shown in FIG. 1, the handle 75 held to be rotatable in a prescribed rotation range is configured so that its grip part 75*a* is in contact with the surface of the heat insulation duct 15 in a state in which the fixation unit 70 has been attached to a prescribed position. The configuration of these components will be described in detail later.

As for X, Y and Z-axes in FIG. 1, the Y-axis is taken in the rotation axis direction of the photosensitive drums 52, the Z-axis is taken in the vertical direction, and the X-axis is taken in a direction orthogonal to both of the Y-axis and the Z-axis. When the X, Y and Z-axes are shown in other drawings explained later, the directions of these axes are assumed to indicate common directions in the drawings. Namely, the X, Y and Z-axes in each drawing indicate the direction of arrangement in a case where the part in the drawing constitutes a part of the image forming device 100 shown in FIG. 1. Further, it is assumed here that the image forming device 100 is placed so that a direction orthogonal to an under surface of the image forming device 100 is substantially in the Z-axis direction.

Figure 2A:
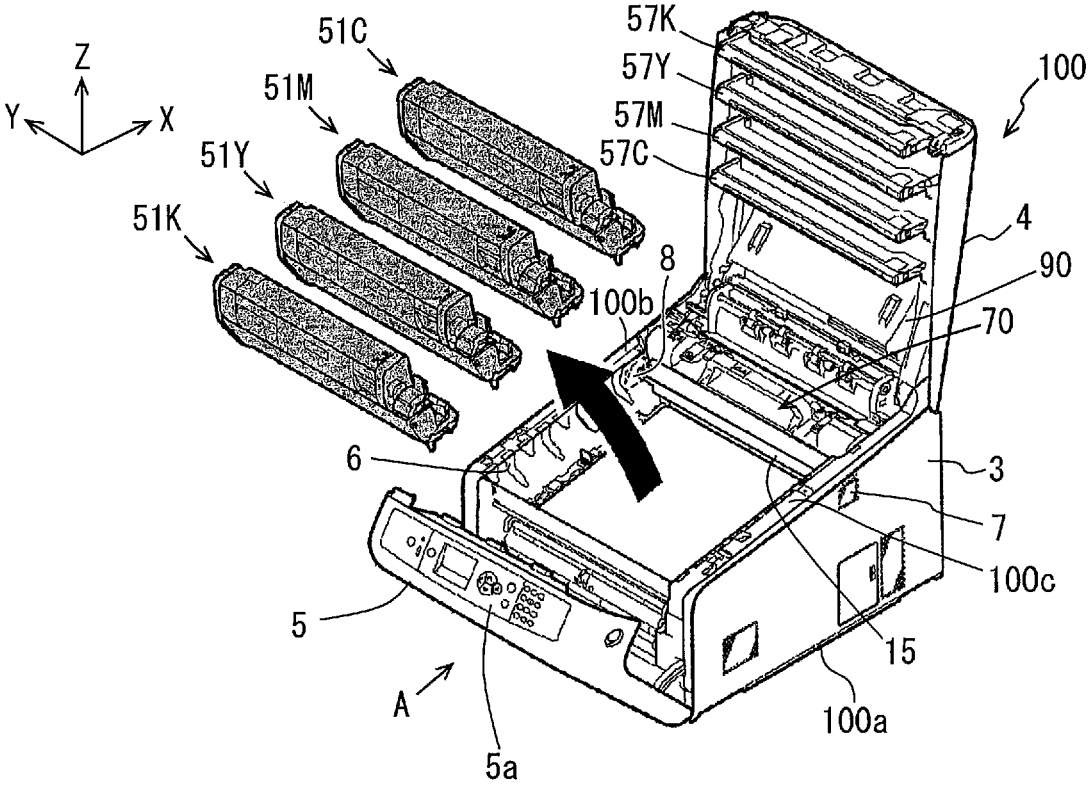
Figure 2B:
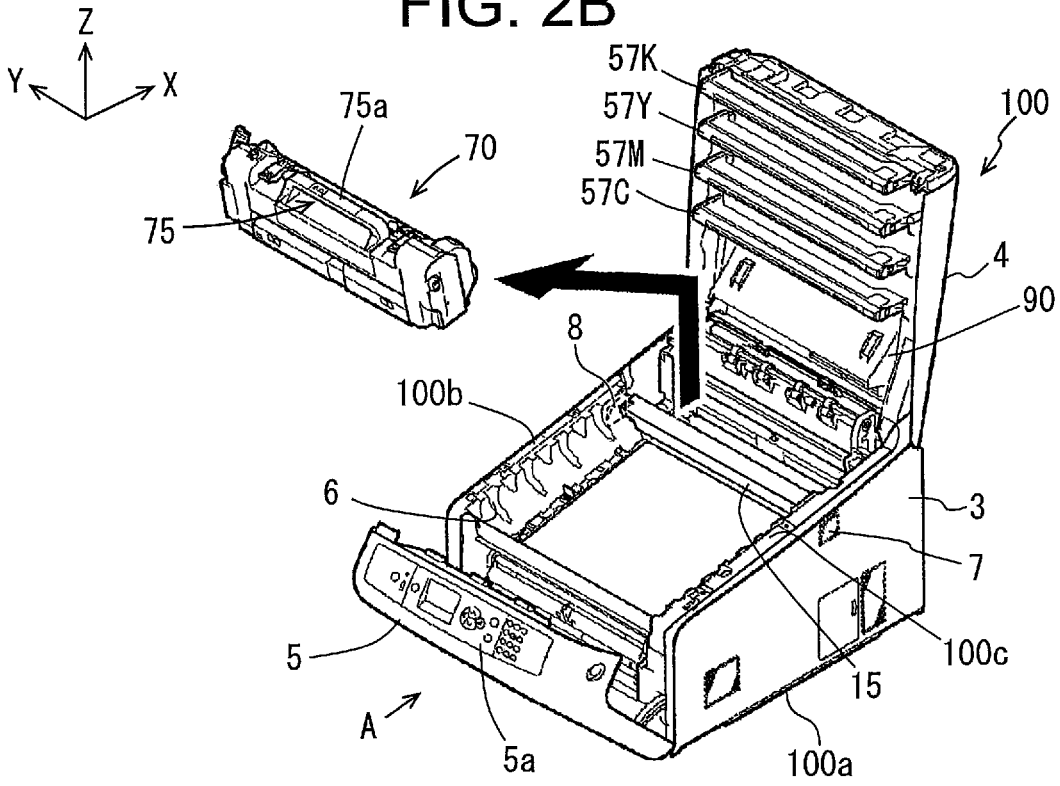

FIG. 2 is an external perspective view showing a state in which the development units 51 and the fixation unit 70 have been removed from a main body 100*a* of the image forming device 100, wherein FIG. 2A shows a state in which the development units 51 have been removed and FIG. 2B shows a state in which the fixation unit 70 has also been removed.

As shown in FIG. 2A, an upper cover 4 is configured to be rotatable with respect to the main body 100*a* of the image forming device 100 around a non-illustrated rotary shaft which is provided in the vicinity of the ejection roller pair 82 (FIG. 1) and extends in the Y-axis direction, and to be able to rotate to an open position, where the upper cover 4 is in a substantially vertical state shown in FIG. 2A, and remain at the open position. Incidentally, as shown in FIG. 2A, LED heads 57K, 57Y, 57M and 57C are configured to be attached to the upper cover 4 and to shift between prescribed operating positions shown in FIG. 1 and withdrawn positions shown in FIG. 2 according to the rotation of the upper cover 4. Further, the aforementioned ejection tray 90 also constitutes a part of the upper cover 4.

A front cover 5 is configured to be rotatable with respect to the main body 100*a* of the image forming device 100 around a non-illustrated rotary shaft which is provided in the vicinity of the sheet feed section 20 (FIG. 1) and extends in the Y-axis direction, and to be able to rotate to a leaned open position shown in FIG. 2A and remain at the open position. Incidentally, this front cover 5 is provided with an operation panel 5*a* and so forth.

In the state in which both of the upper cover 4 and the front cover 5 are opened to the open positions, the operator can remove the development units 51 from the attachment positions and pull out the development units 51 in the direction of an arrow as shown in FIG. 2A. In this case, the development units 51 are pulled out along guide grooves 6 formed on the main body 100*a* of the image forming device 100 which respectively correspond to the development units 51. Also at the time of attaching, the development units 51 are guided to the attachment positions by the guide grooves 6 which respectively correspond the development units 51.

FIG. 2B shows a state where the fixation unit 70 has also been detached from its attachment position and extracted in the direction of an arrow after the four development units 51 from the main body 100*a* of the image forming device 100 have been extracted. In this case, the operator grips the grip part 75*a* of the handle 75 of the fixation unit 70 and pulls out the fixation unit 70.

Incidentally, a part of the image forming device 100 in which detachable or movable components such as the development units 51 of the image forming device 100 have been excluded is referred to as the main body 100*a* of the image forming device 100. Further, there will be cases where the left and right, the top and bottom, and the front and rear of the image forming device 100 viewed from the operation panel 5*a*'s side (in the direction of an arrow A) are specified.

As shown in FIG. 2, the heat insulation duct 15 is configured to extend between a left side part 100*b* and a right side part 100*c* of the image forming device 100. Air outside the device is sent into the heat insulation duct 15 at its left end part which is in contact with the left side part 100*b* by a fan 8 arranged in the left side part 100*b*. The outside air sent in flows through the duct, reaches a right end part of the duct, and is discharged to the outside of the device via an air vent 7 formed in the right side part 100*c* and an outer casing 3 of the main body 100*a* of the image forming device 100 to be in contact with the right end part.

Figure 3A:
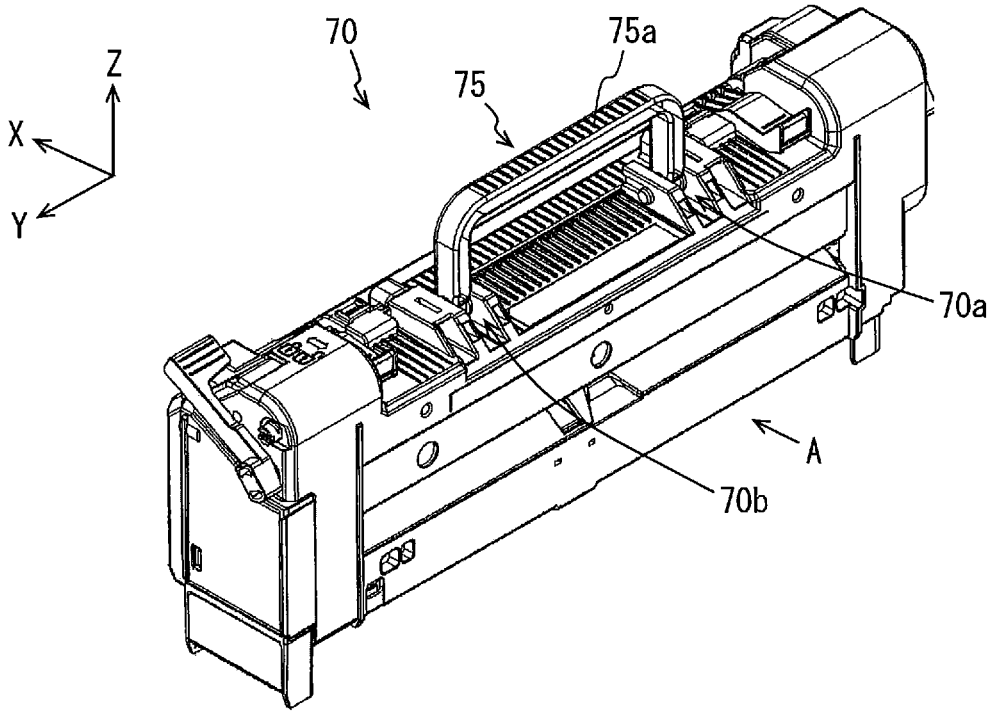
Figure 3B:
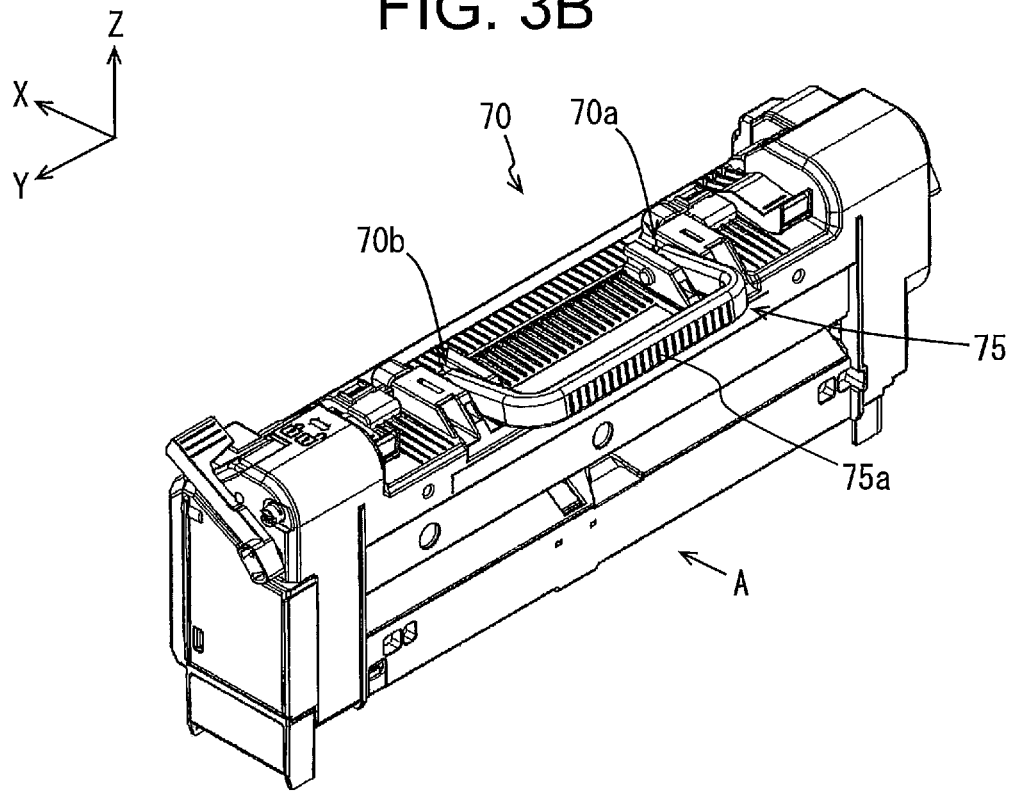

FIG. 3 is an external perspective view of the fixation unit 70, wherein FIG. 3A shows a state in which the handle 75 is at an operational position as a first position of projecting upward from the upper part of the fixation unit 70 and FIG. 3B shows a state in which the handle 75 is at an operating position as a second position of bending forward from the upper part of the fixation unit 70.

As shown in FIG. 3, the fixation unit 70 is configured to allow the operator to grip the grip part 75*a* of the handle 75 and carry the fixation unit 70. The handle 75 is configured so that the grip part 75*a* and a pair of attachment parts, provided to substantially orthogonally extend from both end parts of the grip part 75*a* to face each other, are formed substantially in a U-shape, the both end parts of the handle 75 are rotatably held by holding parts 70*a* and 70*b* provided on the upper part of the fixation unit 70, and the handle 75 is rotatable by approximately 90 degrees from the operational position shown in FIG. 3A to the operating position shown in FIG. 3B.

When the handle 75 is at the operational position shown in FIG. 3A, the grip part 75*a* of the handle 75 is situated to project upward from the upper part of the main body of the fixation unit 70, and as explained earlier with reference to FIG. 2B, the operator is enabled to grip the grip part 75*a* and extract the fixation unit 70 from the image forming device 100, attach the fixation unit 70 to the prescribed position in the device from the outside of the device, and so forth.

In contrast, when the fixation unit 70 is at the prescribed position in the image forming device 100 and the upper cover 4 is at a closed position as shown in FIG. 1, the handle 75 of the fixation unit 70 is situated at the operating position shown in FIG. 3B so that at least the grip part 75*a* of the handle 75 is in contact with a part of the heat insulation duct 15, such as a top surface part of the heat insulation duct 15, as will be described later.

Figure 4A:
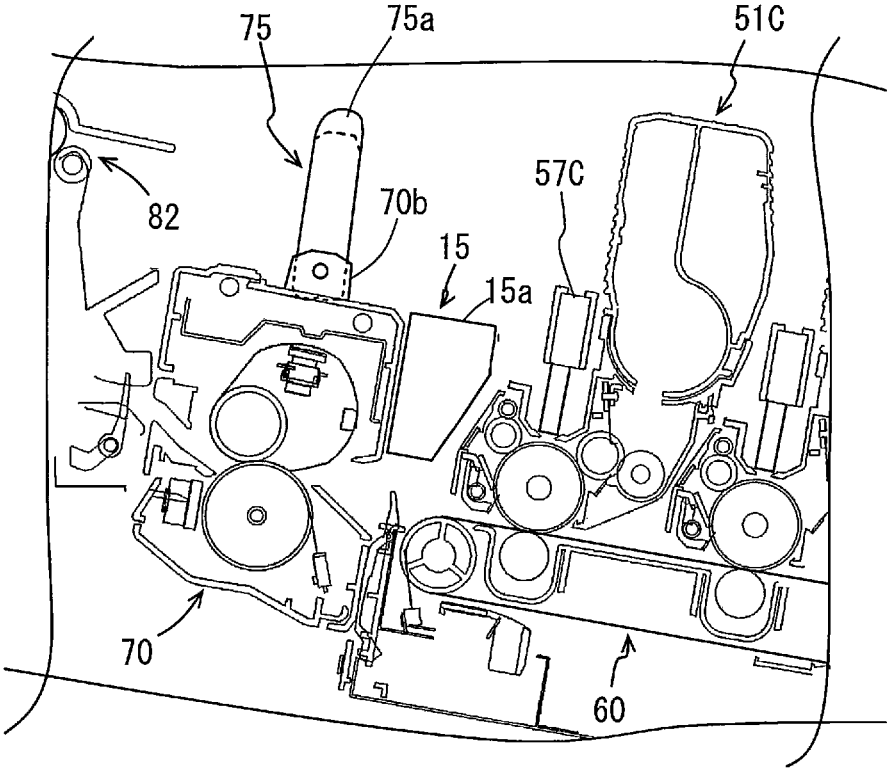
Figure 4B:
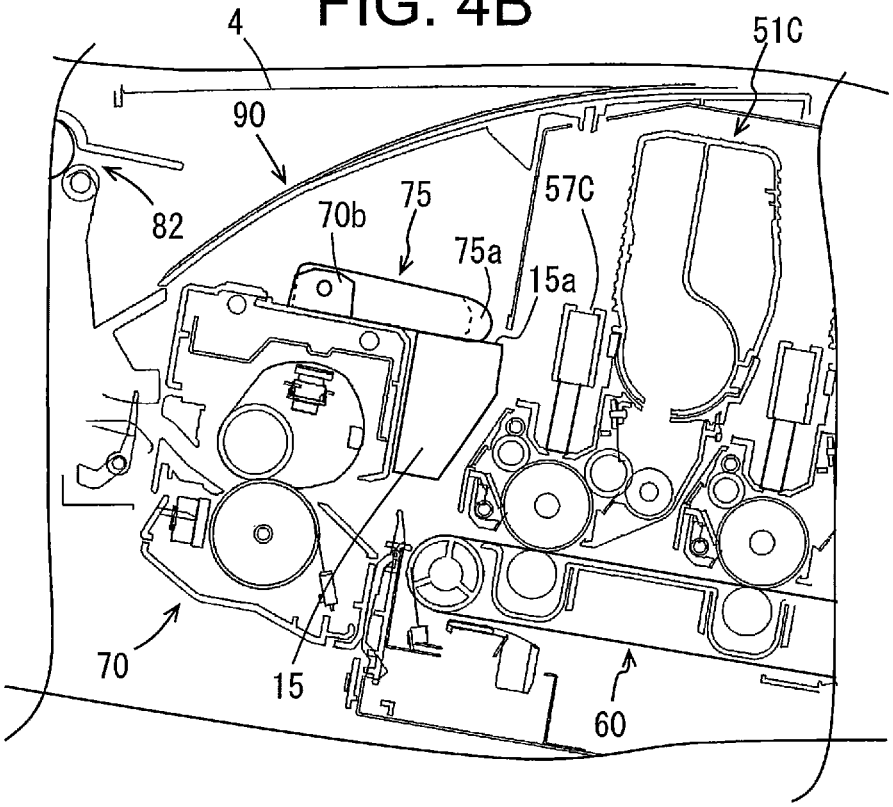

FIG. 4 is a partially enlarged view magnifying the fixation unit 70 attached to the prescribed position in the image forming device 100 and a part in the vicinity of the fixation unit 70, wherein FIG. 4A shows a state in which the upper cover 4 is at the open position and the handle 75 of the fixation unit 70 is at the operational position and FIG. 4B shows a state in which the handle 75 of the fixation unit 70 is at the operating position and the upper cover 4 is at the closed position.

FIG. 4A shows the state in which the upper cover 4 of the image forming device 100 is at the open position (see FIG. 2), which corresponds to a case where the operator detaches the fixation unit 70 from the attachment position of the main body 100*a* of the image forming device 100 and extracts the fixation unit 70 to the outside of the device, a case where the operator has attached the fixation unit 70 to the attachment position from the outside of the device, and so forth, and the handle 75 is at the operational position with its grip part 75*a* projecting upward from the upper part of the fixation unit 70.

FIG. 4B shows the state in which the fixation unit 70 has been attached to the attachment position of the main body 100*a* of the image forming device 100 and the handle 75 of the fixation unit 70 is at the operating position, and, for example, FIG. 4B shows the state in which the image forming device 100 is performing a print operation. In this case, the upper cover 4 is at the closed position and a part of the handle 75 including at least the grip part 75*a* is in contact with the top surface 15*a* of the heat insulation duct 15 so that the heat of the handle 75 can move to the outside air flowing in the heat insulation duct 15 via the duct.

As described above, with the image forming device 100 according to this embodiment, since the handle 75 of the fixation unit 70 is in contact with the surface of the heat insulation duct 15 at least in the print operation of the image forming device 100, the heat transmitted from the heat source 71*a* of the fixation unit 70 to the handle 75 can be released to the heat insulation duct 15 in which the outside air for the cooling flows, and thereby the temperature rise of the grip part 75*a* of the handle 75 can be inhibited.

First Modification

FIG. 5 is a partially enlarged view showing a principal part configuration of a modification of the image forming device according to the first embodiment. The image forming device according to the first modification differs from the above-described image forming device 100 shown in FIG. 1 in the configuration of a heat insulation duct 115 (corresponding to the heat insulation duct 15 in the image forming device 100 of FIG. 1).

Figure 5A:
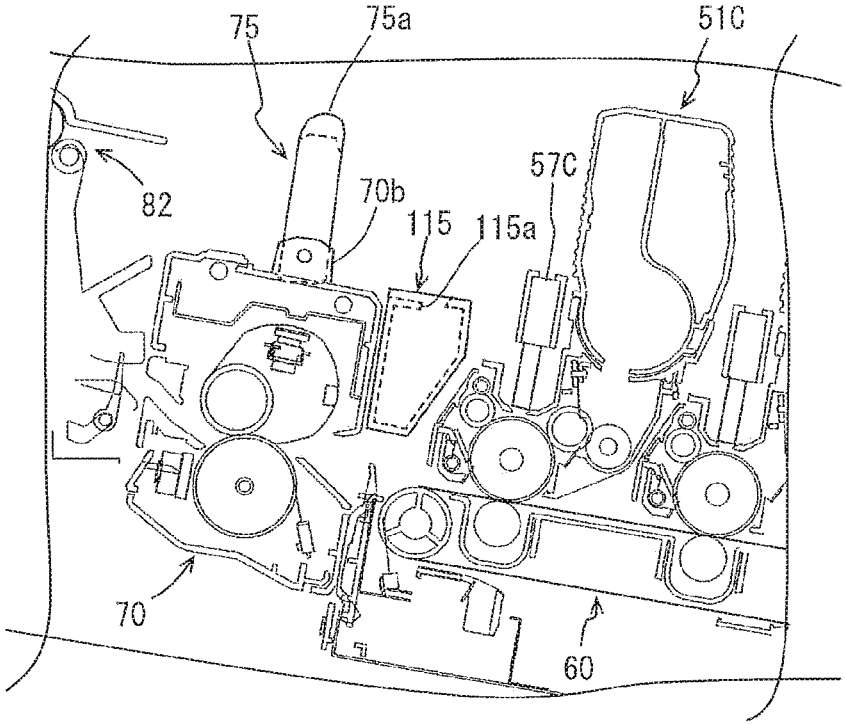
Figure 5B:
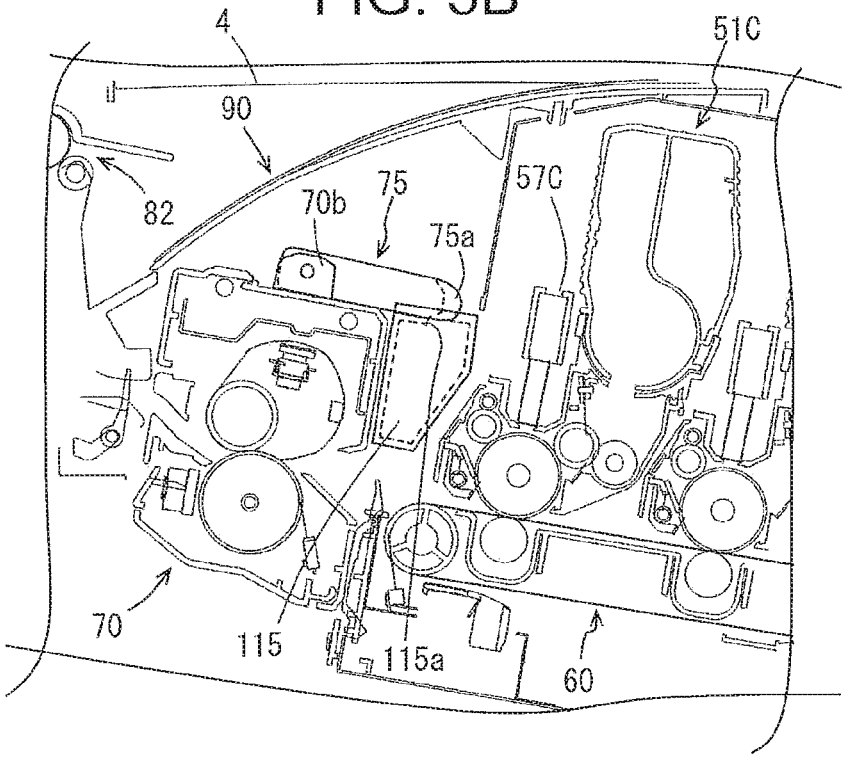

FIG. 5 is a partially enlarged view magnifying the fixation unit 70 attached to the prescribed position in the image forming device in the first modification and a part in the vicinity of the fixation unit 70, wherein FIG. 5A shows the state in which the upper cover 4 is at the open position and the handle 75 of the fixation unit 70 is at the operational position and FIG. 5B shows the state in which the handle 75 of the fixation unit 70 is at the operating position and the upper cover 4 is at the closed position.

As shown in FIG. 5, the heat insulation duct 115 in this example has an opening 115*a* formed through its top surface. As shown in FIG. 5B, the opening 115*a* has a shape to be covered at least by the grip part 75*a* of the handle 75 when the handle 75 of the fixation unit 70 is at the operating position. Therefore, the heat insulation duct 115 is formed so that the handle 75 fits in the operating position also in the vicinity of the opening 115*a*.

With the above-described configuration, the grip part 75*a* of the handle 75 makes direct contact with the outside air flowing in the inside of the heat insulation duct 115.

Accordingly, with the image forming device according to the modification, the handle 75 of the fixation unit 70 is capable of releasing heat by making direct contact with the outside air flowing in the inside of the heat insulation duct 115 at least in the print operation of the image forming device, and thereby the temperature rise of the grip part 75*a* of the handle 75 can be inhibited more efficiently.

Second Embodiment

Figure 6:
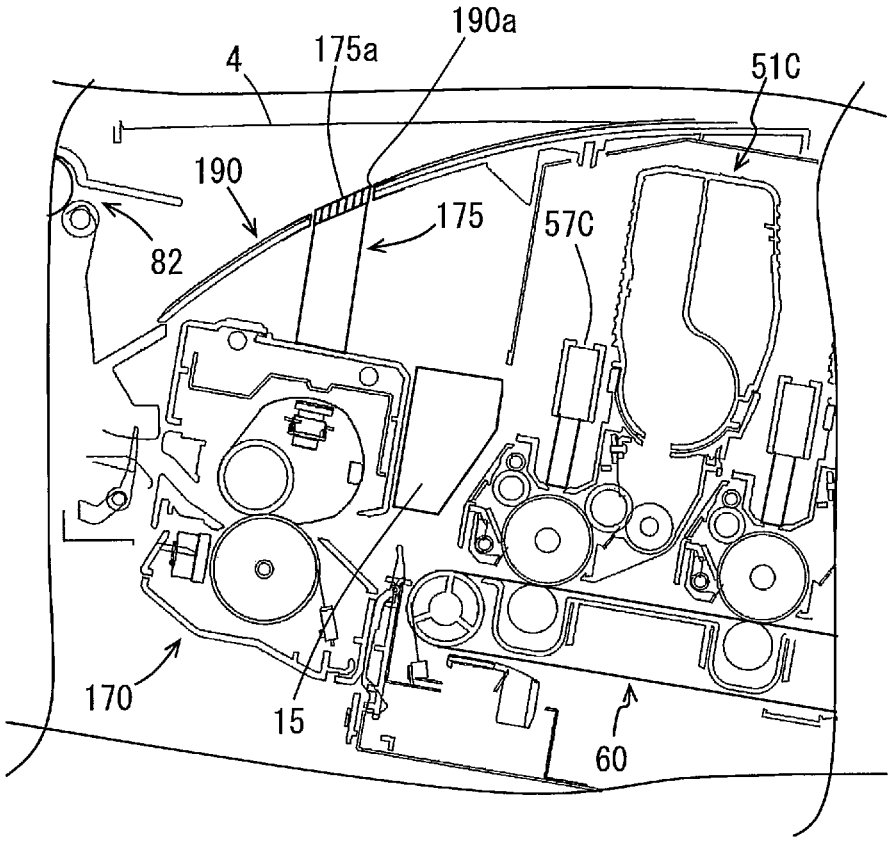
FIG. 6 is a partially enlarged view showing the configuration of a fixation unit and a part in the vicinity thereof in an image forming device according to a second embodiment of the present invention.

FIG. 6 is a partially enlarged view showing the configuration of a fixation unit 170 and a part in the vicinity thereof in an image forming device according to a second embodiment of the present invention.

The configuration of this image forming device differs from the above-described configuration of the image forming device 100 in the first embodiment shown in FIG. 1 mainly in the configuration of a handle 175 (corresponding to the handle 75 in the first embodiment) of the fixation unit 170 (corresponding to the fixation unit 70 in the first embodiment) and the shape of a part of an ejection tray 190 (corresponding to the ejection tray 90 in the first embodiment).

Thus, the description is omitted for each part which is common to the image forming device including this fixation unit 170 and the image forming device 100 in the above-described first embodiment while the part is assigned the same reference character as in the first embodiment or the illustration thereof is omitted, and the difference from the first embodiment will be mainly described below. Incidentally, FIG. 1 will be referred to as needed in the following description since the configuration of the image forming device in this embodiment is basically in common with the principal part configuration of the image forming device 100 in the first embodiment shown in FIG. 1 except for the configuration of the fixation unit 170 and the shape of the part of the ejection tray 190.

FIG. 6 is a partially enlarged view magnifying the fixation unit 170 attached to a prescribed position in the image forming device in this embodiment and a part in the vicinity of the fixation unit 170.

As shown in FIG. 6, the fixation unit 170 in this example includes the handle 175 fixedly arranged on the upper part of the fixation unit 170 integrally with the fixation unit 170. This handle 175 is famed substantially in a U-shape similarly to the handle 75 in the first embodiment shown in FIG. 3 and arranged fixedly to stand from the upper part of the fixation unit 170. The grip part 175*a* of the handle 75 have a top surface as an inclined surface inclined with respect to the standing direction.

On the other hand, the ejection tray 190 is provided with an opening 190*a* as an opening part as shown in FIG. 6, and the position and the shape of the opening 190*a* are designed and the inclined surface of the grip part 175*a* are formed so that the grip part 175*a* of the handle 175 fits in the opening 190*a* and a mount surface of the ejection tray 190 is flush with the inclined surface of the grip part 175*a* when the upper cover 4 is at the closed position for the closed state.

Thus, the handle 175 of the fixation unit 170 is configured so that the top surface of the grip part 175*a* is directly exposed to the outside of the image forming device and accordingly the heat of the handle 175 can move to the outside of the device via the top surface of the grip part 175*a*.

Incidentally, while the mount surface of the ejection tray 190 and the inclined surface of the grip part 175*a* are formed to be flush with each other in this embodiment, the configuration is not limited to this example; various modes may be employed such as configuring the ejection tray 190 and the grip part 175*a* so that the top surface of the grip part 175*a* is exposed to the outside via the opening 190*a* without the need of fitting the grip part 175*a* in the opening 190*a*, for example.

As described above, with the image forming device according to this embodiment, since the top surface of the grip part 175*a* of the handle 175 of the fixation unit 170 is exposed to the outside of the device at least in the print operation of the image forming device, the heat transmitted from the heat source 71*a* of the fixation unit 170 to the handle 175 can be released to the outside of the device, and thereby the temperature rise of the grip part 175*a* of the handle 175 can be inhibited.

Third Embodiment

Figure 7:
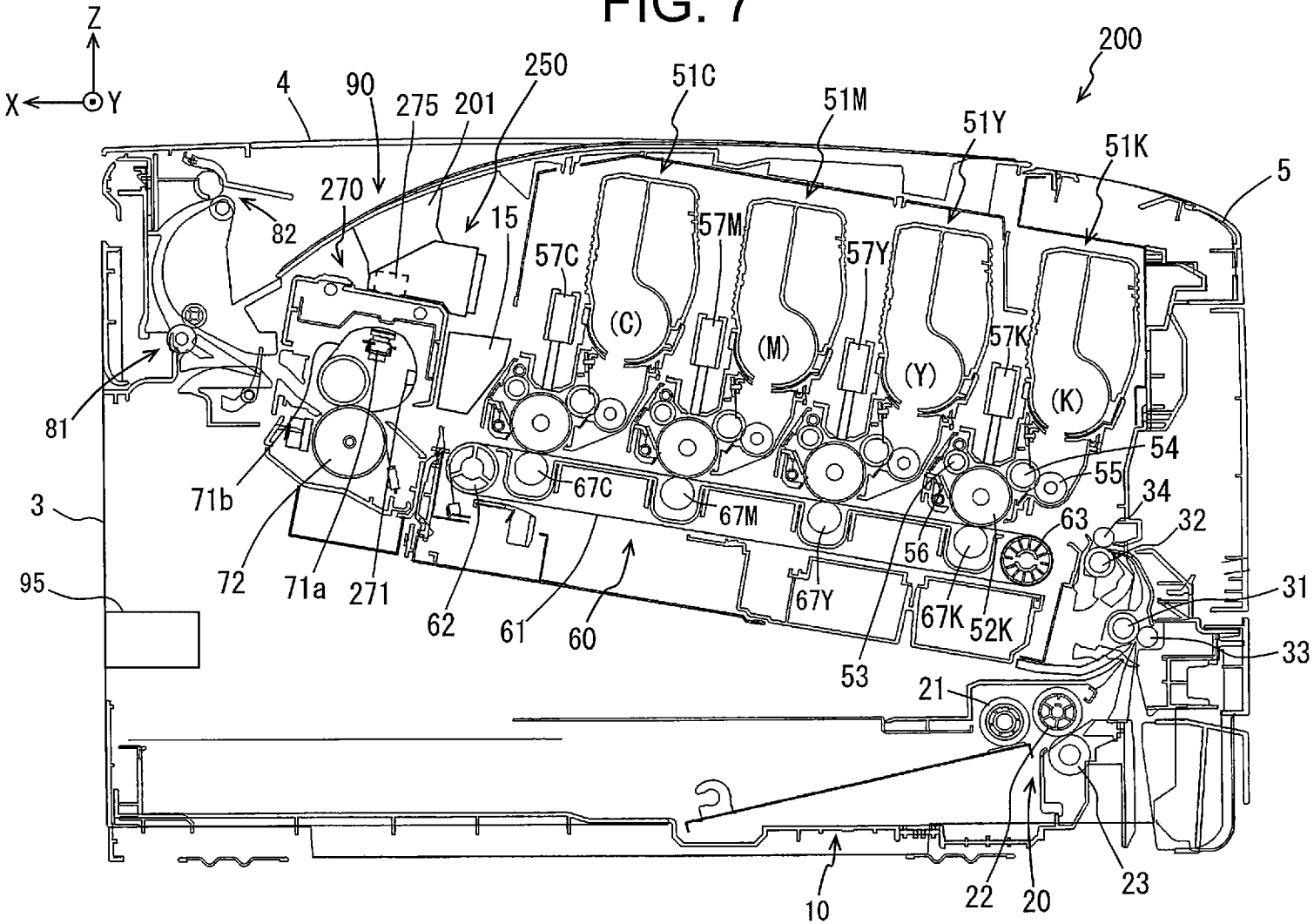
FIG. 7 is a principal part configuration diagram showing a principal part configuration of an image forming device according to a third embodiment of the present invention.

FIG. 7 is a principal part configuration diagram showing a principal part configuration of an image forming device 200 according to a third embodiment of the present invention.

The configuration of this image forming device 200 differs from the configuration of the image forming device 100 in the first embodiment shown in FIG. 1 mainly in the configuration of a handle 275 (corresponding to the handle 75 in the first embodiment) of a fixation unit 270 (corresponding to the fixation unit 70 in the first embodiment) and addition of a cooling unit 250. Thus, the description is omitted for each part which is common to the image forming device 200 and the image forming device 100 in the first embodiment while the part is assigned the same reference character as in the first embodiment or the illustration thereof is omitted, and the difference from the first embodiment will be mainly described below.

As shown in FIG. 7, in the image forming device 200 according to this embodiment, the handle 275 of the fixation unit 270 is fixedly provided on the main body of the fixation unit, the cooling unit 250 is arranged fixedly on the upper cover 4 by a holding member 201, and a ventilation cover 250*b* (see FIG. 9) of the cooling unit 250 is configured to cover a prescribed part of the handle 275 of the fixation unit 270 when the upper cover 4 is at the closed position as explained later. Further, the image forming device 200 includes a drive control section 95 that performs drive control on the entire device and a temperature detector 271 as a temperature detection section that detects the temperature of a prescribed part of the fixation unit 270, namely, left and right sheet non-passage parts 76 and 77 (see FIG. 13) of the fixation belt 71*b* in this example, and transmits information indicating the detected temperature to the drive control section 95.

Figure 8:
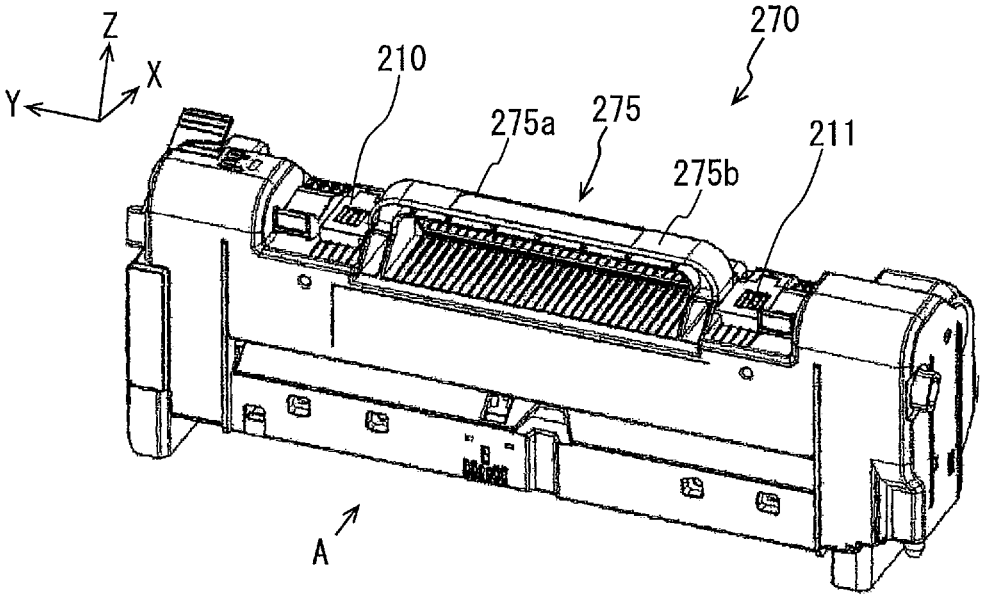
FIG. 8 is an external perspective view of a fixation unit in the third embodiment.

FIG. 8 is an external perspective view of the fixation unit 270 in the third embodiment.

As shown in FIG. 8, the fixation unit 270 is configured to allow the operator to grip a grip part 275*a* of the handle 275 and carry the fixation unit 270. The handle 275 is formed substantially in a U-shape. Both end parts of the handle 275 are fixed to the upper part of the main body of the fixation unit 270 and formed to be integral with the main body of the fixation unit 270.

Left and right air vents 210 and 211 as a pair are formed in the left and right vicinity of the both end parts of the fixed handle 275. While details will be described later, each of the left air vent 210 and the right air vent 211 is connected to a cooling duct extending to a prescribed position in the inside of the fixation unit 270.

Figure 9:
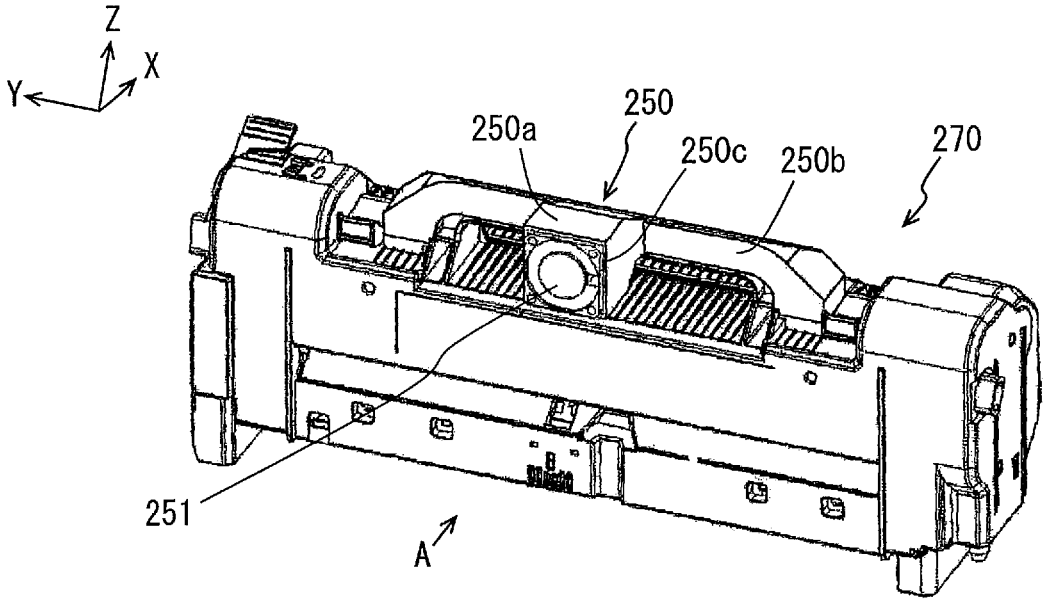
FIG. 9 is an external perspective view showing the fixation unit and a cooling unit engaging with the fixation unit in the third embodiment.

FIG. 9 is an external perspective view showing the fixation unit 270 and the cooling unit 250 engaging with the fixation unit 270. The positional relationship between the fixation unit 270 and the cooling unit 250 in FIG. 9 corresponds to the positional relationship between the fixation unit 270 and the cooling unit 250 when the upper cover 4 of the image forming device 200 is at the closed position as shown in FIG. 7.

As shown in FIG. 9, the cooling unit 250 includes the ventilation cover 250*b* as a ventilation cover part that covers the prescribed part of the handle 275 extending in a lengthwise direction of the fixation unit 270 (Y-axis direction) and an air blow cover part 250*a* that is situated in a central part of the cooling unit 250 and has an opening part 250*c* in which a fan motor 251 that sends cooling air to the inside of the ventilation cover 250*b* is fixed. Incidentally, the air blow cover part 250*a* and the fan motor 251 correspond to an air blow section.

Figure 10:
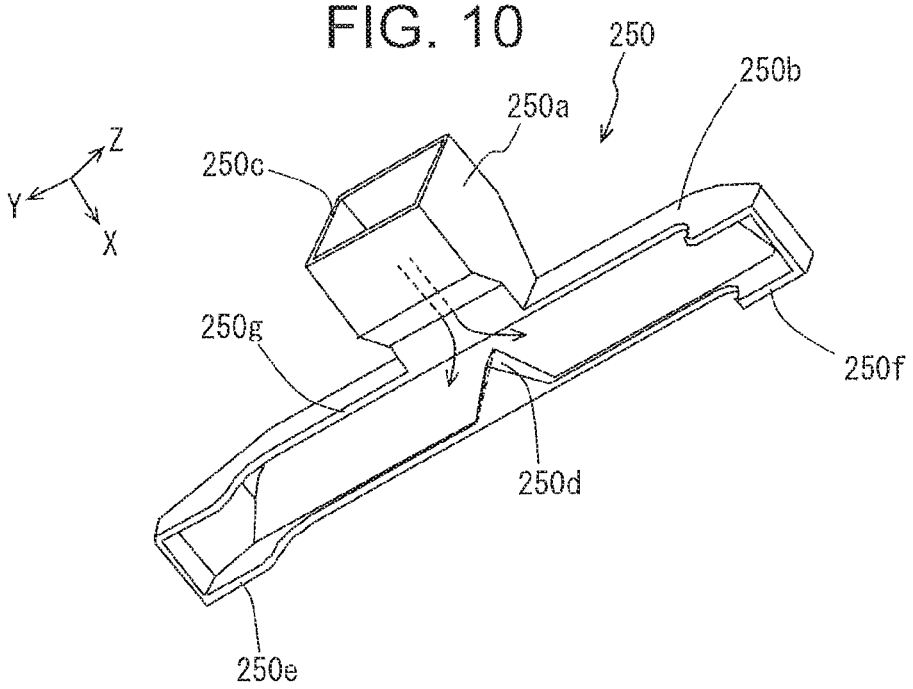
FIG. 10 is an external perspective view of the cooling unit viewed from obliquely below in the third embodiment, wherein a fan motor attached to an opening part is omitted.

FIG. 10 is an external perspective view of the cooling unit 250 viewed from obliquely below. Incidentally, the fan motor 251 attached to the opening part 250*c* is omitted in FIG. 10.

As shown in FIG. 10, the opening part 250*c* connects to the inside of the ventilation cover 250*b*, and a wedge-shaped splitting projection 250*d* is formed on an inner wall in the inside of the ventilation cover 250*b* and facing the opening part 250*c*. An under surface of the ventilation cover 250*b* is formed of a handle contact part 250*g* famed to be in contact with both end parts of an outer surface 275*b* of the substantially U-shaped handle 275 (see FIG. 8) in regard to a width direction (substantially in the X-axis direction), a left-side contact part 250*e* formed to be in contact with a peripheral part of the left air vent 210 of the fixation unit 270 so as to cover the left air vent 210, and a right-side contact part 250*f* formed to be in contact with a peripheral part of the right air vent 211 of the fixation unit 270 so as to cover the right air vent 211, and a continuous curved surface is formed by these parts.

Accordingly, when the upper cover 4 of the image forming device 200 is at the closed position, a ventilation duct 230 (see FIG. 12) through which the opening part 250*c* connects to the left and right air vents 210 and 211 of the fixation unit 270 is formed by the ventilation cover 250*b* and the outer surface 275*b* (see FIG. 8) of the handle 275 as shown in FIG. 9.

Thus, the cooling air sent in from the opening part 250*c* by the fan motor 251 is split left and right by the splitting projection 250*d* in the ventilation duct 230 as shown in FIG. 10, and then the cooling air flows into the left and right air vents 210 and 211 (see FIG. 8) while making contact with the outer surface 275*b* of the handle 275.

Figure 11:
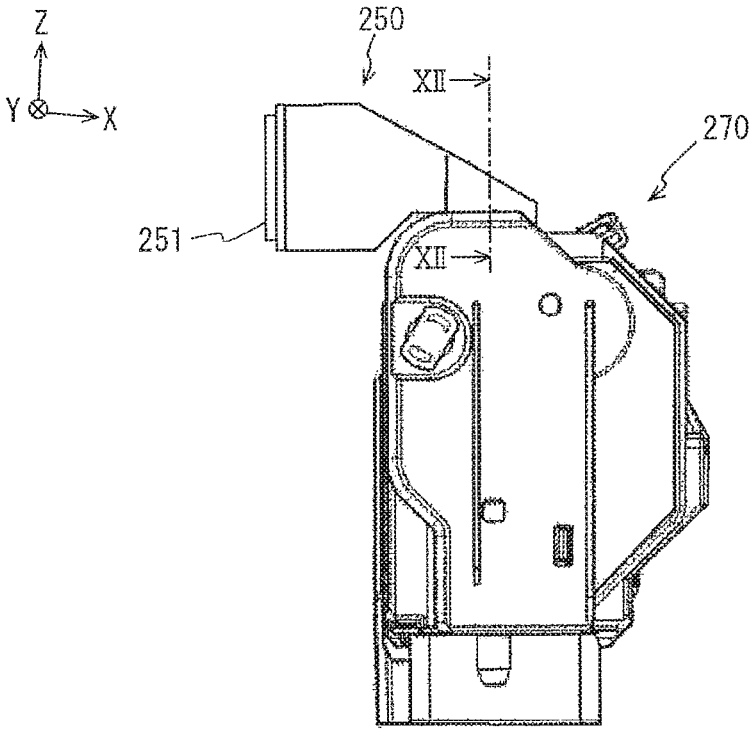
FIG. 11 is a right side view of the fixation unit and the cooling unit forming a ventilation duct as shown in FIG. 9.
Figure 12:
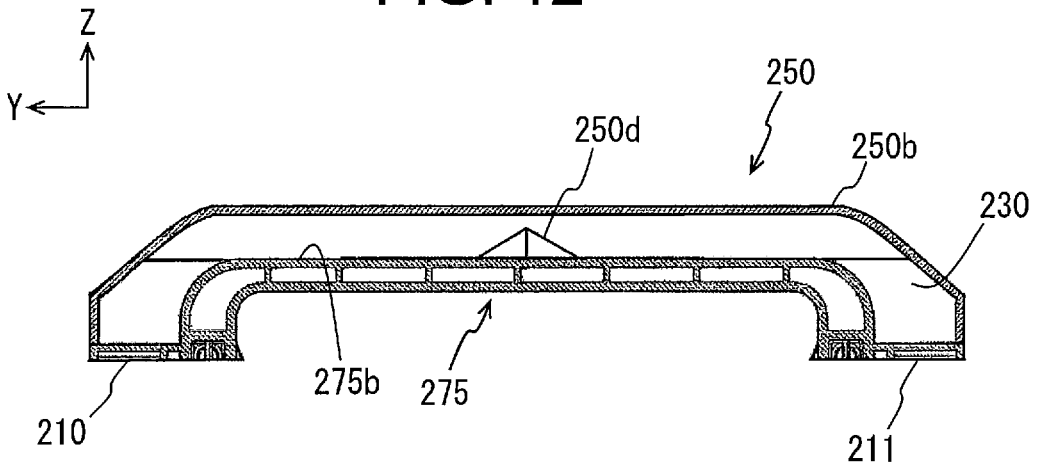
FIG. 12 is a cross-sectional view taken along the line XII-XII shown in FIG. 11, wherein only a region where the cooling unit and the handle exist is shown.

FIG. 11 is a right side view of the fixation unit 270 and the cooling unit 250 forming the ventilation duct 230 (see FIG. 12) as shown in FIG. 9, and FIG. 12 is a cross-sectional view taken along the line XII-XII shown in FIG. 11. Incidentally, only a region where the cooling unit 250 and the handle 275 exist is shown in FIG. 12.

As shown in FIG. 12, the ventilation duct 230 is formed by the outer surface 275*b* of the handle 275 and the ventilation cover 250*b* of the cooling unit 250, and the ventilation duct 230 extends to the left and right air vents 210 and 211.

Figure 13:
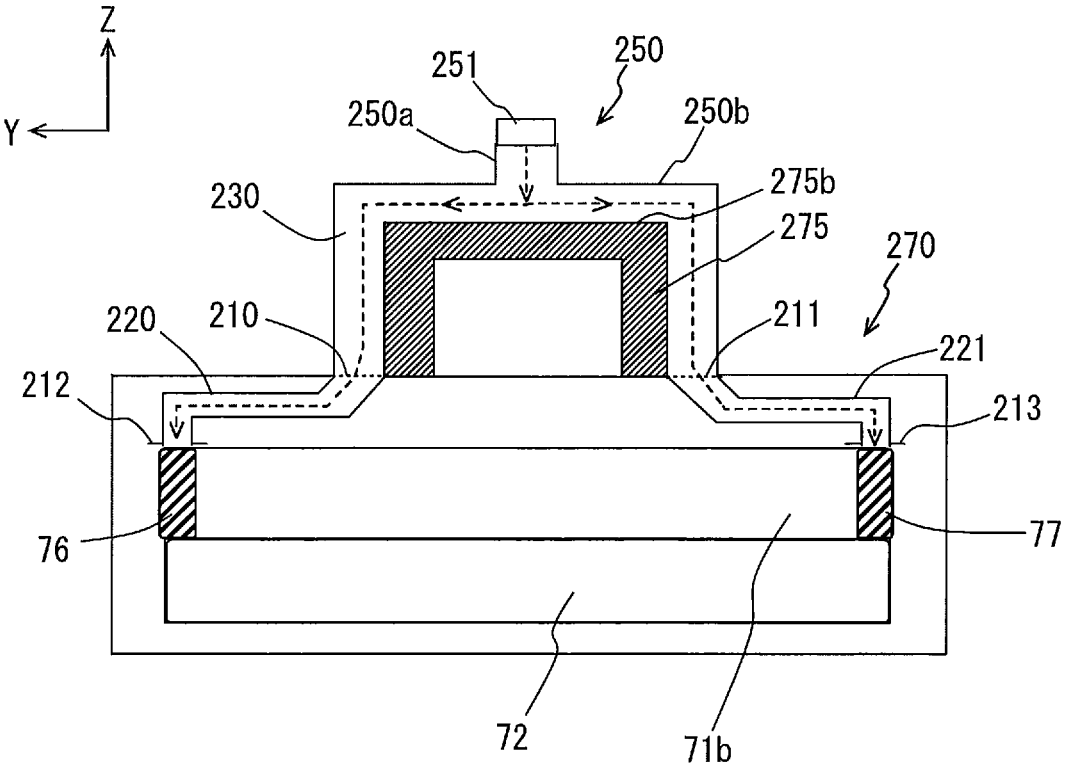
FIG. 13 is a schematic explanatory drawing schematically showing channels for cooling air sent into the ventilation duct by the fan motor of the cooling unit in a state in which the ventilation duct has been famed by a ventilation cover and an outer surface of the handle.

FIG. 13 is a schematic explanatory drawing schematically showing channels for the cooling air sent into the ventilation duct 230 by the fan motor 251 of the cooling unit 250 in the state in which the ventilation duct 230 has been formed by the ventilation cover 250*b* and the outer surface 275*b* (see FIG. 8) of the handle 275.

As shown in FIG. 13, in the inside of the fixation unit 270, a left duct 220 is formed from the left air vent 210 to a left discharge part 212 situated in the vicinity of the left sheet non-passage part 76 corresponding to a left end part of the fixation belt 71*b* and the outside of a passage region of the recording sheet, and similarly, a right duct 221 is formed from the right air vent 211 to a right discharge part 213 situated in the vicinity of the right sheet non-passage part 77 corresponding to a right end part of the fixation belt 71*b* and the outside of the passage region of the recording sheet.

In the configuration described above, the cooling air sent into the ventilation duct 230 by the fan motor 251 is split left and right by the splitting projection 250*d* (FIG. 12), and then the cooling air advances in the ventilation duct 230 while making contact with the outer surface 275*b* of the handle 275 and eventually flows into the left and right ducts 220 and 221 via the left and right air vents 210 and 211.

The cooling air which has entered the left duct 220 advances in the left duct 220, reaches the left discharge part 212, and is discharged from the left discharge part 212 towards the left sheet non-passage part 76 of the fixation belt 71*b*. Similarly, the cooling air which has entered the right duct 221 advances in the right duct 221, reaches the right discharge part 213, and is discharged from the right discharge part 213 towards the right sheet non-passage part 77 of the fixation belt 71*b*.

Figure 14:
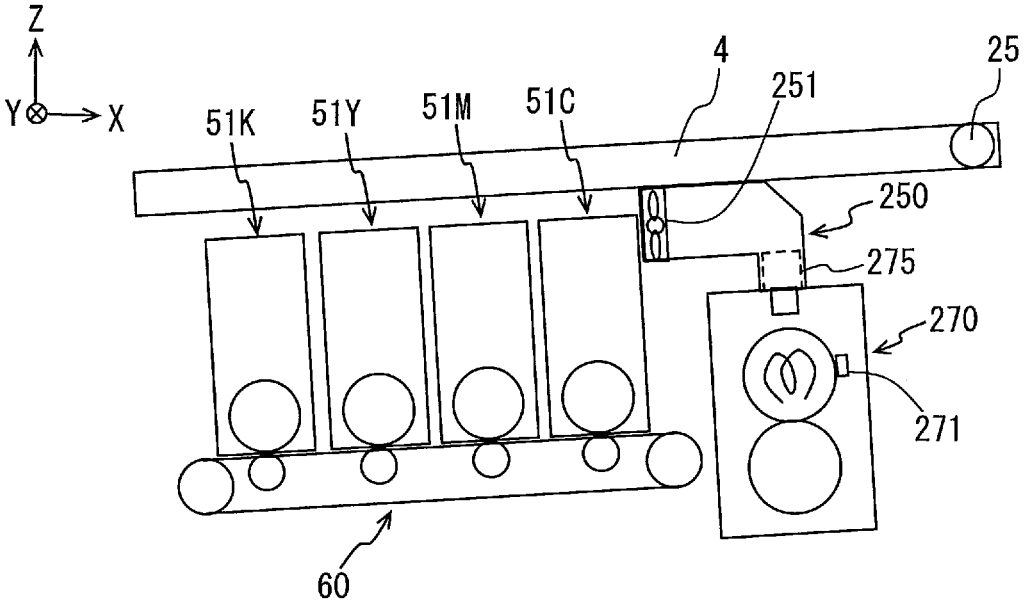
FIG. 14 is an operation explanatory diagram schematically showing an engagement relationship between the cooling unit provided on the upper cover and the fixation unit arranged in the image forming device in the third embodiment.
Figure 15:
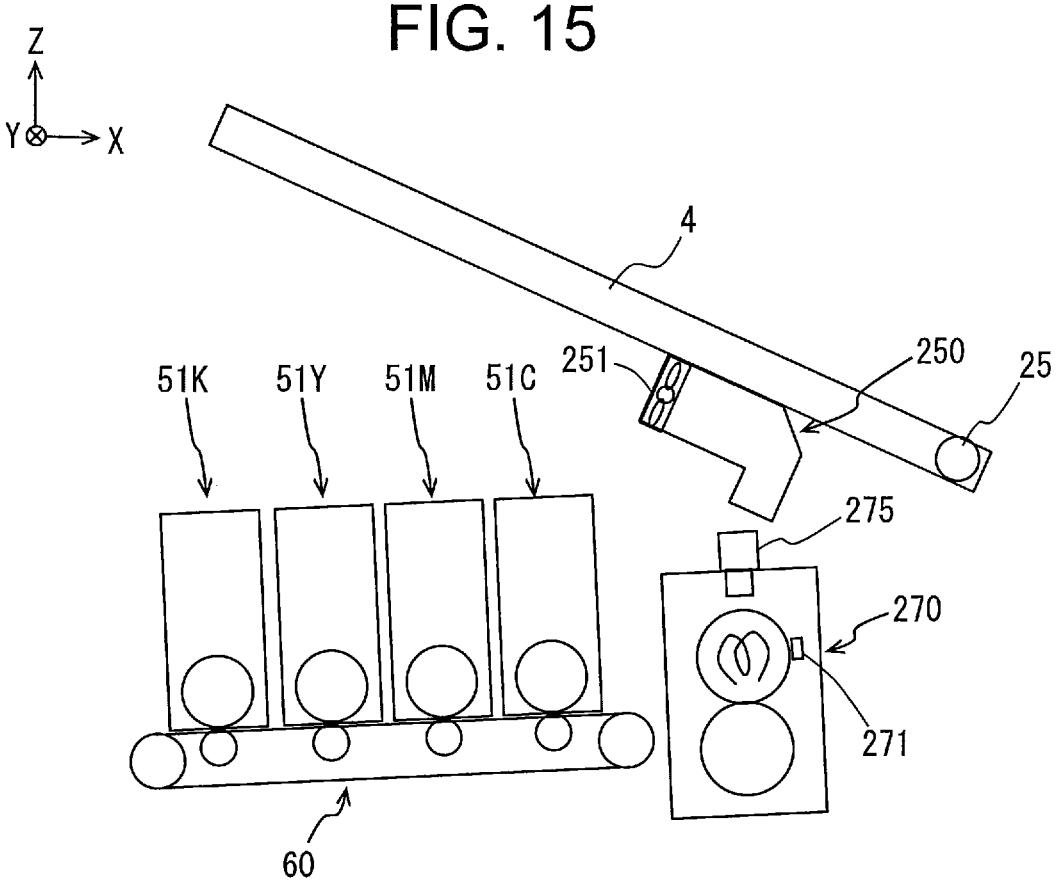
FIG. 15 is an operation explanatory diagram schematically showing the engagement relationship between the cooling unit provided on the upper cover and the fixation unit arranged in the image forming device in the third embodiment.

FIG. 14 and FIG. 15 are operation explanatory diagrams schematically showing an engagement relationship between the cooling unit 250 provided on the upper cover 4 of the image forming device 200 and the fixation unit 270 arranged in the image forming device 200 as shown in FIG. 7, wherein FIG. 14 corresponds to the state in which the upper cover 4 is at the closed position and FIG. 15 corresponds to a state in which the upper cover 4 has been opened towards the open position (see FIG. 2) to a position where the fixation unit 270 and the cooling unit 250 are separate from each other. Incidentally, FIG. 14 and FIG. 15 are diagrams showing the cooling unit 250 and the fixation unit 270 viewed from the opposite side as compared with FIG. 7.

As shown in FIG. 14, the upper cover 4 is held to be rotatable around a rotary shaft 25 provided in the vicinity of the ejection roller pair 82 (FIG. 7) and extending in the Y-axis direction, and the upper cover 4 is provided with the cooling unit 250. When the upper cover 4 is at the closed position as shown in FIG. 14, the cooling unit 250 and the handle 275 of the fixation unit 270 are in the engagement relationship. The engagement relationship mentioned here means a state in which the ventilation duct 230 (see FIG. 12) has been formed by the ventilation cover 250*b* (see FIG. 9) of the cooling unit 250 and the outer surface 275*b* (see FIG. 8) of the handle 275 as explained above with reference to FIG. 9 to FIG. 13.

In contrast, while the upper cover 4 opens to the open position shown in FIG. 2, the cooling unit 250 and the fixation unit 270 separate from each other as shown in FIG. 15, and at the stage when the upper cover 4 has reached the open position shown in FIG. 2, the handle 275 of the fixation unit 270 is perfectly exposed and the cooling unit 250 withdraws to a position not hindering the attachment/detachment operation of the fixation unit 270.

In the configuration described above, the drive control section 95 (FIG. 7) monitors the temperature of the left and right sheet non-passage parts 76 and 77 of the fixation belt 71*b* detected by the temperature detector 271 in the print operation, and sends the cooling air into the ventilation duct 230 by activating the fan motor 251 when the temperature reaches a temperature higher than or equal to a prescribed value. The cooling air sent into the ventilation duct 230 by the fan motor 251 flows into the left and right ducts 220 and 221 (FIG. 13) in the inside of the fixation unit 270 while making contact with and cooling the outer surface 275*b* of the handle 275 as explained with reference to FIG. 13, is discharged from the left discharge part 212 towards the left sheet non-passage part 76 of the fixation belt 71*b* or from the right discharge part 213 towards the right sheet non-passage part 77 of the fixation belt 71*b*, and cools the left and right sheet non-passage parts 76 and 77.

Thereafter, when a drop of the temperature of the left and right sheet non-passage parts 76 and 77 (FIG. 13) to a temperature lower than or equal to a prescribed value is detected, the drive control section 95 (FIG. 7) stops the operation of the fan motor 251. Due to the above-described drive control continued during the printing, the fan motor 251 repeats the operation and the stoppage.

Incidentally, while the ventilation duct 230 (FIG. 12) is formed by the contact of the handle contact part 250*g* (FIG. 10) of the cooling unit 250 with the both end parts of the outer surface 275*b* of the handle 275 (FIG. 8) of the fixation unit 270 in the above description of this embodiment, the formation of the ventilation duct 230 is not limited to this example; various modes may be employed such as configuring the ventilation duct so that a ventilation cover 250*b* of the cooling unit 250 covers the handle 275.

As described above, with the image forming device 200 according to this embodiment, the handle 275 of the fixation unit 270 is cooled by the cooling air flowing in the ventilation duct 230 upon each activation of the fan motor 251, by which the temperature rise of the grip part 275*a* of the handle 275 can be inhibited.

Further, since the device is configured so that the outer surface 275*b* of the handle 275 fixed to the main body of the fixation unit 270 is used as a wall surface of the ventilation duct 230, a structure having high rigidity can be made without the need of limiting the shape of the handle. Furthermore, since the cooling unit 250 is attached to the upper cover 4 and shifts integrally with the upper cover 4 accompanying the rotation of the upper cover 4, the work of attaching/detaching the fixation unit 270 can be carried out without the need of performing an extra operation.

Fourth Embodiment

Figure 16:
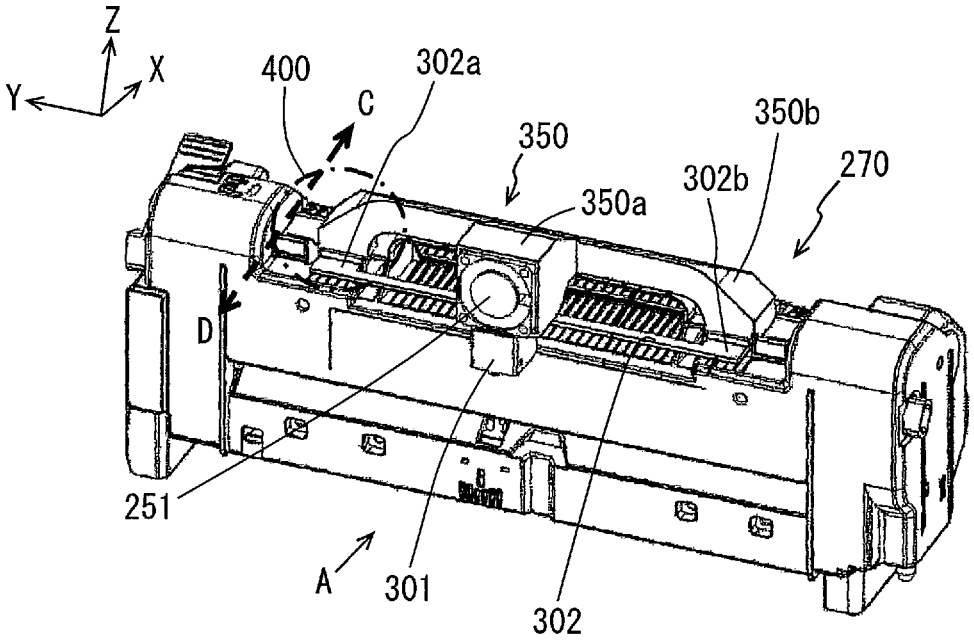
FIG. 16 is an external perspective view showing the fixation unit and a cooling unit employed for an image forming device according to a fourth embodiment of the present invention.
Figure 17:
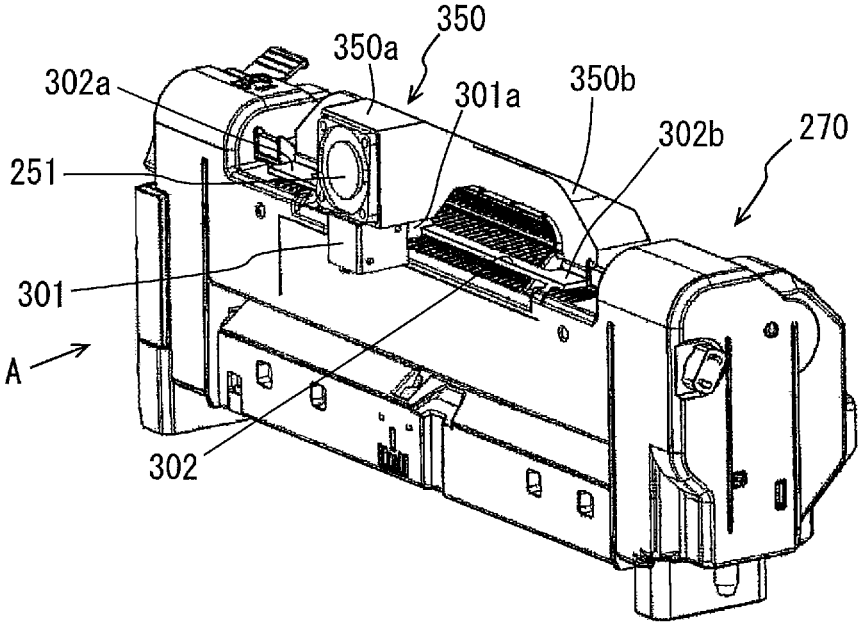
FIG. 17 is an external perspective view showing the fixation unit and the cooling unit viewed in a different angle as compared to FIG. 16.

FIG. 16 is an external perspective view showing the fixation unit 270 and a cooling unit 350 employed for an image forming device according to a fourth embodiment of the present invention. FIG. 17 is an external perspective view showing the fixation unit 270 and the cooling unit 350 viewed in a different angle as compared to FIG. 16.

The configuration of the image forming device employing this cooling unit 350 differs from the above-described configuration of the image forming device 200 in the third embodiment shown in FIG. 7 mainly in that a shutter member 302 and a solenoid 301 that drives the shutter member 302 are added in the configuration of the cooling unit 350 (corresponding to the cooling unit 250 in the third embodiment) and the shape of a ventilation cover 350*b* is partially changed from the shape of the ventilation cover 250*b* in the third embodiment because of the addition. Thus, the description is omitted for each part which is common to the image forming device according to the fourth embodiment and the image forming device 200 in the above-described third embodiment while the part is assigned the same reference character as in the third embodiment or the illustration thereof is omitted, and the difference from the third embodiment will be mainly described below.

The cooling unit 350 in this embodiment includes the solenoid 301 as a power section fixedly disposed in a lower part of an air blow cover part 350*a* of the cooling unit 350 and the shutter member 302 driven and slid by the solenoid 301. The shutter member 302 includes a left shutter part 302*a*, a right shutter part 302*b*, and a support part situated between and formed integrally with the left and right shutter parts 302*a* and 302*b*.

At least in the stage when the upper cover 4 of the image forming device closes and the ventilation duct 230 (see FIG. 12) is formed as shown in FIG. 16, the left shutter part 302*a* is situated between the left air vent 210 (FIG. 8) of the fixation unit 270 and the left-side contact part (corresponding to 250*e* in FIG. 10) of the ventilation cover 350*b*, the right shutter part 302*b* is situated between the right air vent 211 (FIG. 8) of the fixation unit 270 and the right-side contact part (corresponding to 250*f* in FIG. 10) of the ventilation cover 350*b*, and the shutter member 302 is held to be slidable in the direction of arrows C and D shown in FIG. 16 (substantially in the X-axis direction).

The solenoid 301, whose shaft 301*a* is connected to the center of the support part of the shutter member 302, undergoes on-off drive control by the drive control section 95 (FIG. 7). The shutter member 302 is pulled in the direction of the arrow D by the on operation of the solenoid 301, or moved in the direction of the arrow C by a non-illustrated biasing member when the solenoid 301 is off.

Figure 18:
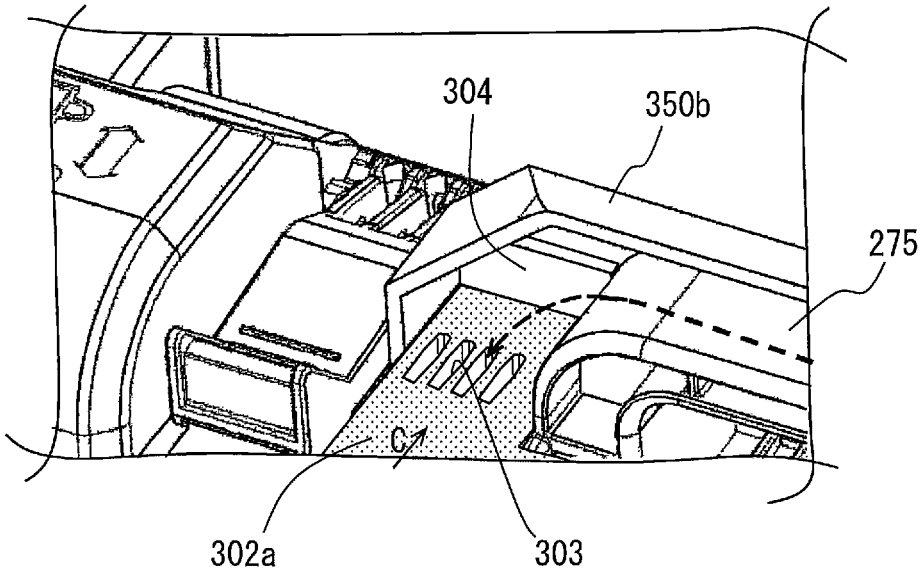
FIG. 18 is a partially enlarged view of a part surrounded by a chain line in FIG. 16, showing a state in which a shutter member has moved in a direction of an arrow C.
Figure 19:
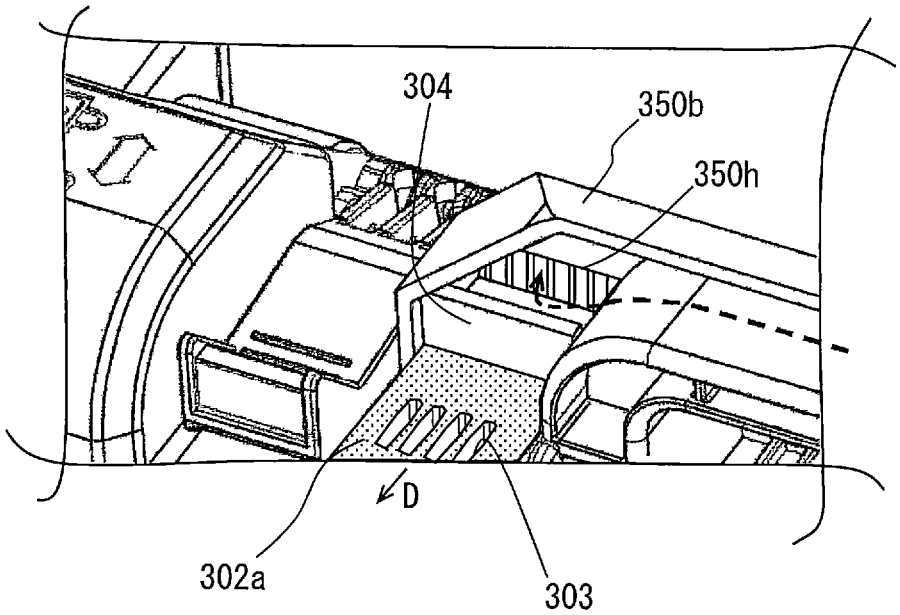
FIG. 19 is a partially enlarged view of the part surrounded by the chain line in FIG. 16, showing a state in which the shutter member has moved in a direction of an arrow D.

FIG. 18 and FIG. 19 are partially enlarged views of the part surrounded by the chain line 400 in FIG. 16, wherein FIG. 18 shows a state in which the shutter member 302 has moved in the direction of the arrow C and FIG. 19 shows a state in which the shutter member 302 has moved in the direction of the arrow D. In FIG. 18 and FIG. 19, the ventilation cover 350*b* is drawn in a state in which its front half is omitted in order to show the inside of the ventilation cover 350*b*.

As shown in FIG. 18, the left shutter part 302*a* is formed in a shape like a flat plate, an opening 303 is formed in a part of the left shutter part 302*a*, and a wall surface 304 is provided at an end of the left shutter part 302*a* in the direction of the arrow C. On the other hand, as shown in FIG. 19, a discharge port 350*h* is formed in a wall part of the ventilation cover 350*b* facing the wall surface 304.

As shown in FIG. 18, when the solenoid 301 turns off and the shutter member 302 moves in the direction of the arrow C, the wall surface 304 of the shutter member 302 presses against the wall surface of the ventilation cover 350*b* where the discharge port 350*h* is formed, occludes the discharge port 350*h* while being prohibited from moving in the direction, and at this stage, the opening 303 is situated at a position overlapping with the left air vent 210 (FIG. 8) of the fixation unit 270.

Accordingly, the cooling air sent into the ventilation duct 230 (see FIG. 12) by the fan motor 251 is sent into the left duct 220 (FIG. 13) in the inside of the fixation unit 270 via the opening 303 and the left air vent 210 (FIG. 8) as indicated by an arrow in FIG. 13. Incidentally, since the left shutter part 302*a* and the right shutter part 302*b* are configured to be bilaterally symmetrical, on the right-hand side, the cooling air is sent into the right duct 221 (FIG. 13) in the inside of the fixation unit 270 in a similar manner.

In contrast, as shown in FIG. 19, when the solenoid 301 turns on and the shutter member 302 moves in the direction of the arrow D, the wall surface 304 of the shutter member 302 separates from the discharge port 350*h* of the ventilation cover 350*b*, and the opening 303 moves to and stops at a position deviated from the left air vent 210 (FIG. 8) of the fixation unit 270.

Accordingly, the cooling air sent into the ventilation duct 230 (see FIG. 12) by the fan motor 251 does not enter the inside of the fixation unit 270 and escapes to the rear of the device through the discharge port 350*h* of the ventilation cover 350*b* as indicated by an arrow in FIG. 19. Incidentally, since a discharge port (not shown) is famed also at a position on the ventilation cover 350*b* facing a wall surface (not shown) of the right shutter part 302*b* on the right-hand side, the cooling air escapes to the rear of the device through the discharge port of the ventilation cover 350*b* in a similar manner also on the right-hand side.

In the configuration described above, the drive control section 95 (FIG. 7) activates the fan motor 251 at the same time as the start of printing, monitors the temperature of the left and right sheet non-passage parts 76 and 77 (FIG. 13) of the fixation belt 71*b* detected by the temperature detector 271 as the temperature detection section, and sends the cooling air into the fixation unit 270 by turning off the solenoid 301 when the temperature reaches a temperature higher than or equal to a prescribed value. The cooling air sent into the fixation unit 270 flows into the left and right ducts 220 and 221 (FIG. 13) in the fixation unit 270 as shown in FIG. 18, is discharged from the left discharge part 212 towards the left sheet non-passage part 76 of the fixation belt 71*b* or from the right discharge part 213 towards the right sheet non-passage part 77 of the fixation belt 71*b*, and cools the left and right sheet non-passage parts 76 and 77.

Thereafter, when a drop of the temperature of the left and right sheet non-passage parts 76 and 77 (FIG. 13) to a temperature lower than or equal to a prescribed value is detected, the drive control section 95 (FIG. 7) turns on the solenoid 301 and thereby discharges the cooling air to the outside through the discharge ports 350*h* of the ventilation cover 350*b* as shown in FIG. 19 without sending the cooling air into the inside of the fixation unit 270.

Due to the above-described drive control continued during the printing, the solenoid 301 repeats turning on and off and adjusts the temperature in the fixation unit 270 while the fan motor 251 keeps on operating.

As described above, with the image forming device according to this embodiment, irrespective of the temperature of the fixation unit 270, the handle 275 of the fixation unit 270 is cooled during the print operation by the cooling air constantly flowing in the ventilation duct 230, and thereby the temperature rise of the grip part 275*a* of the handle 275 can be inhibited stably.

Incidentally, while terms like "top", "bottom", "right", "left", "front" and "rear" have been used in the above description of the embodiments, these tams are used for convenience and are not intended to limit the absolute positional relationship in the state of arranging the image forming device.

INDUSTRIAL APPLICABILITY

While the above embodiments have been described by taking a printer as an example of the image forming device, the present invention is useful for not only color printers but also other types of image forming devices such as copying machines, FAX machines, MFPs (Multi Function Peripherals) having functions as a combination of the functions of these devices, and so forth. Further, while the above description has been given by taking a tandem color printer including a plurality of development units as an example of the image forming device, the present invention is useful also for monochrome image forming devices including one development unit.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. An image forming device comprising:

a development unit that forms a developing agent image;

a fixation unit that includes a handle including a grip part and fixes the developing agent image transferred to a record medium on the record medium; and a duct that is situated between the development unit and the fixation unit and inhibits transmission of heat of the fixation unit to the development unit, wherein the handle is provided to be able to shift between a first position for being gripped by an operator and a second position at which the handle is in contact with the duct.

2. The image forming device according to claim 1, wherein the handle is provided to be rotatable between the first position and the second position.

3. The image forming device according to claim 1, wherein at least the grip part of the handle is in contact with a surface of the duct when the handle is at the second position.

4. The image forming device according to claim 1, wherein the duct has an opening connecting to an internal space of the duct and the opening is occluded by a part of the handle when the handle is at the second position.

5. The image forming device according to claim 4, wherein the part of the handle is the grip part.

6. The image forming device according to claim 1, wherein the handle is formed in a U-shape and includes both end parts that are rotatably held by a main body of the fixation unit.

7. An image forming device comprising:

a cover that covers a main body of the image forming device and has an opening part; and a fixation unit that is provided to be detachable from the main body of the image forming device and includes a part of a handle for being gripped by an operator when the fixation unit is detached, wherein the part of the handle is exposed to an outside of the image forming device via the opening part when the image forming device is performing an operation to form an image.

8. The image forming device according to claim 7, wherein when the cover is at the position at which the inside of the main body of the image forming device is closed, the part of the handle fits in the opening part and faces the outside of the image forming device.

9. The image forming device according to claim 8, wherein the cover includes an ejection tray in which the opening part is formed and on which a record medium is set, the part of the handle is a grip part, and a record medium mount surface of the ejection tray is flush with a surface of the grip part which faces the outside when the cover is at the position at which the inside of the main body of the image forming device is closed.

10. The image forming device according to claim 7, wherein the cover opens and closes an inside of the main body by rotating around a rotary shaft which is provided in the cover.

11. The image forming device according to claim 7, wherein the cover is an upper cover disposed above the fixation unit.

12. An image forming device comprising:

a main body;

a fixation unit provided on an inside of the main body in a detachable manner;

a cooling unit; and an upper cover that is provided with the cooling unit and is provided to be able to open and close the inside of the main body, wherein the fixation unit includes:

a handle including a grip part;

an air vent provided in a vicinity of the handle, the air vent connecting to an inside of the fixation unit; and a duct situated in the inside of the fixation unit, the duct being disposed between the air vent and a vicinity of a heating section, the cooling unit includes:

an air blow section; and a ventilation cover part, and the ventilation cover part and the handle form a ventilation duct connecting the air blow section and the air vent when the upper cover is at a position at which the inside of the main body is closed.

13. The image forming device according to claim 12, wherein the air blow section includes:

a fan motor; and an air blow cover part that holds the fan motor and sends air sent from the fan motor into the ventilation duct.

14. The image forming device according to claim 13, further comprising:

a drive control section that performs control and driving of a whole of the device; and a temperature detection section that detects a temperature of the heating section and transmits information indicating the temperature to the drive control section, wherein the drive control section performs on-off control of the fan motor according to the temperature of the heating section.

15. The image forming device according to claim 12, wherein an outer surface of the handle serves as an inner wall surface of the ventilation duct.

16. The image forming device according to claim 12, wherein the handle is formed in a U-shape and includes both end parts that are fixed to a main body of the fixation unit, and the air vent is formed in the vicinity of each of the both end parts.

17. The image forming device according to claim 12, wherein an opening part of the duct on a side of the heating section is formed in the vicinity of a part of the heating section.

18. The image forming device according to claim 12, further comprising:

a discharge port formed on the ventilation cover part;

a shutter member provided between the ventilation duct and the air vent; and a power section that shifts the shutter member between a first position and a second position, wherein when the shutter member is at the first position, the shutter member opens the air vent and closes the discharge port to lead air sent from the air blow section to the duct, and when the shutter member is at the second position, the shutter member closes the air vent and opens the discharge port to discharge the air sent from the air blow section to an outside of the ventilation duct.

19. The image forming device according to claim 18, further comprising:

a drive control section that performs control and driving of a whole of the device; and a temperature detection section that detects a temperature of the heating section and transmits information indicating the temperature to the drive control section, wherein the drive control section shifts the shutter member between the first position and the second position according to the temperature of the heating section.

* * * * *